US005601204A

United States Patent [19]

Hall

[11] Patent Number: 5,601,204

[45] Date of Patent: Feb. 11, 1997

[54] TANK VAULT WITH SEALED LINER

[76] Inventor: William Y. Hall, 1360 Capitol Dr., #135, San Pedro, Calif. 90732

[21] Appl. No.: 892,812

[22] Filed: Jun. 5, 1992

Related U.S. Application Data

[63] Continuation-in-part of Ser. No. 759,703, Sep. 11, 1991, abandoned, which is a continuation of Ser. No. 664,411, Feb. 27, 1991, abandoned, which is a continuation of Ser. No. 452,690, Dec. 19, 1989, abandoned.

[51] Int. Cl.[6] ..... B65D 90/04

[52] U.S. Cl. ..... 220/469; 220/444; 220/565

[58] Field of Search ..... 220/444, 565, 220/469, 4.12, 461

[56] References Cited

U.S. PATENT DOCUMENTS

| | | |
|---|---|---|
| 806,458 | 12/1905 | Brady . |
| 1,024,527 | 4/1912 | Searle . |
| 1,056,955 | 3/1913 | Stamm . |
| 1,153,535 | 9/1915 | Babich . |
| 1,180,367 | 4/1925 | Babich . |
| 1,267,495 | 5/1918 | Babich . |
| 1,355,122 | 10/1920 | Bintliff . |
| 2,128,297 | 8/1938 | Ingersoll . |
| 2,148,278 | 2/1939 | Rose . |
| 2,189,945 | 2/1940 | Fitch . |
| 2,643,022 | 6/1953 | Cornell . |
| 2,754,992 | 7/1956 | Wilson . |
| 2,777,295 | 1/1957 | Bliss et al. . |
| 2,892,564 | 6/1959 | Morrison . |
| 3,101,861 | 8/1963 | Mearns, III et al. . |
| 3,118,559 | 1/1964 | Stricker, Jr. . |
| 3,151,416 | 10/1964 | Eakin et al. . |
| 3,338,010 | 8/1967 | Waugh . |
| 3,473,689 | 10/1969 | Hutter . |
| 3,666,132 | 5/1972 | Yamamoto et al. . |
| 3,848,765 | 11/1974 | Durkop . |
| 3,882,591 | 5/1975 | Yamamoto . |
| 3,922,987 | 12/1975 | Tornay . |
| 3,938,689 | 2/1976 | deMunnik . |
| 4,342,713 | 8/1982 | Larkfeldt . |
| 4,374,479 | 2/1983 | Secord . |
| 4,638,920 | 1/1987 | Goodhues . |
| 4,651,893 | 3/1987 | Mooney . |
| 4,826,644 | 5/1989 | Lindquist et al. . |
| 4,844,287 | 7/1989 | Long ..... 220/469 X |
| 4,871,081 | 10/1989 | Ershig . |
| 4,890,983 | 1/1990 | Solomon et al. . |
| 4,895,272 | 1/1990 | DeBenedittis et al. . |
| 4,912,966 | 4/1990 | Sharp . |
| 4,915,545 | 4/1990 | Ferrari . |
| 4,926,644 | 5/1989 | Lindquist et al. . |
| 4,948,340 | 8/1990 | Solomon et al. . |
| 4,960,151 | 10/1990 | Kaminski et al. . |
| 4,974,739 | 12/1990 | Gelin . |
| 4,986,436 | 1/1991 | Babacigno et al. . |
| 4,989,750 | 2/1991 | McGarvey . |
| 4,991,613 | 2/1991 | Kaminski et al. . |

(List continued on next page.)

FOREIGN PATENT DOCUMENTS

| | | |
|---|---|---|
| 62-132098 | 6/1987 | Japan . |

OTHER PUBLICATIONS

Ramirez, Anthony, EPA Should Clean up its Own Act, Fortune Magazine, Nov. 6, 1989, pp. 139, 142.

*Primary Examiner*—Steven M. Pollard
*Attorney, Agent, or Firm*—Law Offices of Gregory L. Roth

[57] ABSTRACT

A liquid container for the above-ground storage of flammable fuels is shown having an inner tank with a bottom surface, side surfaces, and a top surface placed within an outer shell having a bottom surface, side surfaces and an open top. The bottom surfaces of the inner tank and outer shell are spaced apart from each other, as by first bottom spacers which connect the two bottom surfaces. The side walls of the inner tank and outer shell are also spaced apart from each other, as by second side spacers which connect the tank and shell. The spacers for connecting the tank and shell prevent the inner tank from floating within the outer shell when an insulating material, such as concrete, is added therebetween.

21 Claims, 4 Drawing Sheets

U.S. PATENT DOCUMENTS 5,004,632 4/1991 McGarvey et al. .
5,012,949 5/1991 McGarvey .
5,016,689 5/1991 McGarvey et al. .
5,038,456 8/1991 McGarvey .
5,056,017 10/1991 McGarvey .
5,071,166 12/1991 Marino ..... 220/469 X
5,081,761 1/1992 Rinehart et al. ..... 220/444 X
5,082,138 1/1992 McGarvey .
5,103,996 4/1992 McGarvey .
5,231,811 8/1993 Andrepont et al. ..... 220/565 X
5,251,473 10/1993 Reese ..... 220/565 X
5,271,493 12/1993 Hall ..... 220/469
5,282,546 2/1994 Bauer ..... 220/565

FIG. 5
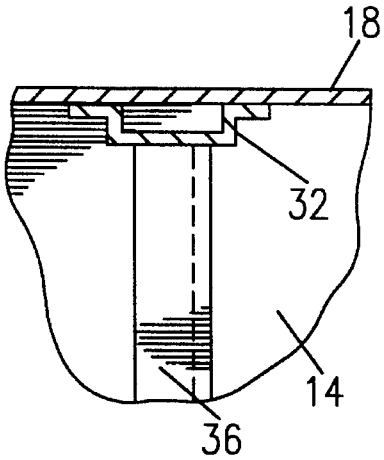
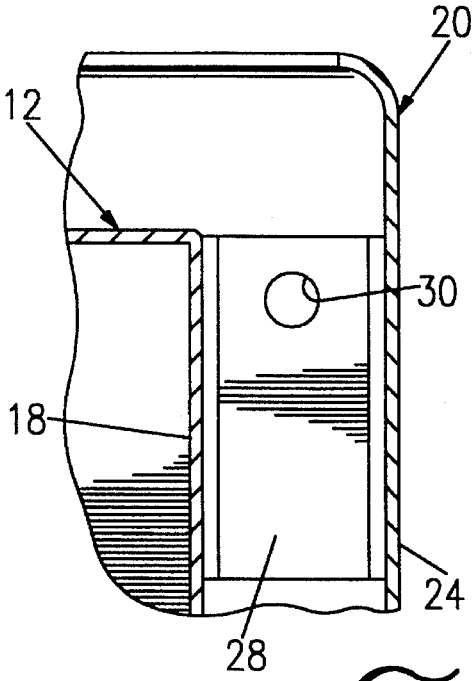
FIG. 6
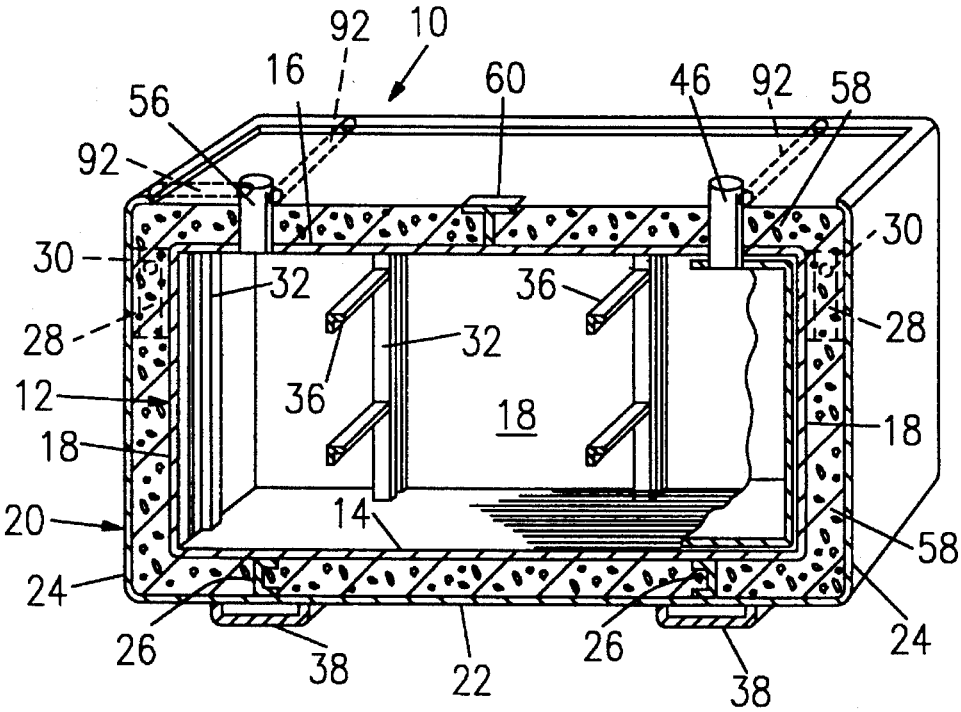
FIG. 7

TANK VAULT WITH SEALED LINER

This is a continuation-in-part of U.S. application Ser. No. 07/759,703, filed Sep. 11, 1991, now abandoned, which is a continuation of U.S. application Ser. No. 07/664,411 filed Feb. 27, 1991, now abandoned, which is a continuation of application Ser. No. 07/452,690, filed Dec. 19, 1989, now abandoned, all of William Y. Hall and entitled "Tank Vault".

BACKGROUND OF THE INVENTION

The present invention relates to a vaulted tank and, more particularly, to an above-ground insulated and sealed storage tank for flammable liquids.

Since the 1970s, the world, and in particular, the United States, has been concerned with the environment and the contamination of that environment, including the earth's soil, its atmosphere and its water. The first Earth Day in 1970 resulted in the eventual creation of the Environmental Protection Agency by the United States Congress.

One of the many problems which the Environmental Protection Agency has addressed is the deterioration of large, underground storage tanks and the resulting leakage of contaminants into the soil. An example of this is the well-documented and widespread deterioration of gasoline station storage tanks and the leakage of gasoline and diesel fuel into the surrounding water table.

To correct this problem, the EPA has suggested that all fuel storage tanks be placed above ground. This has created a classic confrontation between governmental departments, for the fire departments of most major cities prefer that fuel storage tanks be placed below ground to reduce fire hazard, and most municipal codes have been drafted with this concern in mind. In recent years, the creation of large concrete-entombed, above ground tanks has been suggested as a solution to the problem. That is, a gasoline storage tank is entombed in concrete and placed above the ground to enable its surfaces to be easily checked for deterioration and fluid leakage. By entombing it in concrete, the tank is made impervious to impact from a vehicle that might back into it, for example, and becomes resistant to fire due to the insulating effect of the concrete. Such insulation is designed to provide the minimum two-hour fire resistive protection required by the Uniform Fire Code and the National Fire Protection Agency for above ground tanks. One example of such an entombed tank is shown in U.S. Pat. No. 4,826,644, issued May 2, 1989 to T. R. Lindquist and R. Bambacigno.

The concrete entombed tank has several disadvantages, including its high cost and lack of convenience. For example, a 1,000-gallon concrete-entombed tank weighs 18,000 pounds after it has been manufactured. Such a tank requires a large truck and crane with at least two 20-ton nylon straps to transport it to the site where it is to be used and to then place the tank in the desired position. This is not only an arduous undertaking, but it is an expensive one.

The prior art attempted to avoid the problem of transporting such tanks by constructing the concrete casing on site. However, this required the building of special forms on site, and the transport of concrete to the site for pouring. This presented serious logistical problems where the site was in a remote location and often added to the cost.

A further disadvantage of the concrete-entombed tank is that such tanks do not have long-term structural integrity, and they have caused considerable concern in this regard. In order to cover such tanks with concrete, a relatively thick layer is required, adding to the weight of the entire device, and requiring reinforcement of the inner tank so it will withstand the pressure of the entombing material. However, even relatively thick layers of concrete present a reliability problem, for exposure of such tanks to extreme weather conditions, such as wide temperature variations, will cause concrete to crack. It has been found that in as little as a year's time, spider cracks can appear in a concrete casing for a storage tank, thereby compromising its structural integrity. This problem occurs for other casing materials, as well, for foam insulation or light-weight concrete, while reducing the weight problem, still suffer from exposure to the elements and gradually degrade.

A further problem which occurs with cement-like encasement materials is that of rapid failure in case of fire. Although such material is intended to insulate the inner tank, in fact it absorbs heat, so that when water is directed onto the concrete (or like material) it will often crack and fall away from the tank, thus exposing the tank directly to the heat.

SUMMARY OF THE INVENTION

Accordingly, it is an object of the present invention to provide a less expensive, lighter weight and more easily transported tank vault for the above-ground storage of liquid fuels, such as gasoline and diesel fuel.

Another object of the invention is to provide an insulated tank vault for hazardous liquids, wherein the insulating material is protected against exposure to the elements, to provide structural integrity for the insulation and to facilitate construction of the vault.

A further object of the invention is the provision of an exterior liquid-impervious shell surrounding a tank for receiving hazardous liquids, the exterior shell providing containment for fluid insulating material when the tank is being constructed, and providing protection against the elements as well as a second barrier against leakage of the hazardous liquid.

These and other objects are accomplished, in accordance with one embodiment of the invention, by providing an inner tank having a bottom surface, side surfaces, and a top surface which is placed within an outer shell having a bottom surface and side surfaces. The bottom surface of the inner tank is spaced apart from and connected to the bottom surface of the outer shell by first, bottom spacers which do not extend to the side surfaces of either the inner tank or outer shell. The side surfaces of the inner tank and outer shell are spaced apart and attached to one another by second side spacers which do not extend to the bottom surface of either the inner tank or outer shell. The bottom and side spacers function to prevent the inner tank from floating within the outer shell when an insulating material, such as concrete, is placed therebetween.

The utilization of an inner tank and outer shell with appropriate bottom and side spacers for attaching the two permits the assembled tank to be shipped from the factory to the site where it is intended for use with relative ease because of its light weight. Once properly placed upon the site, the space between the inner tank and outer shell can be filled with a suitable insulation material to meet the strength and insulation requirements of the fire codes of all metropolitan areas. Spacing feet on the bottom surface of the outer shell permit all surfaces of the tank vault to be inspected to assure that the tank does not deteriorate and leak. This meets the requirements of the Environmental Protection Agency and the fire departments.

In another embodiment of the invention, the storage tank is assembled at the factory and is delivered to the site where it is to be used in a single piece, as a complete unit ready to use. In order to accomplish this, the space between the inner tank and the outer tank is filled at the factory with cellular concrete, or with perlite, or with an insulating foam. The light weight, insulating cellular concrete does not incorporate an aggregate, but instead is filled with air pockets to substantially reduce its weight, while providing the required insulating characteristics. The insulation is sufficient to enable the tank to withstand a 2,000 degree fire test, with the temperature of the interior wall of the inner tank remaining below the ignition point of the flammable liquid to be stored, e.g., gasoline.

The modified storage tank also includes a leak detection system which includes a wrapping of cellular polypropylene around the inner tank wall. This wrapping preferably is at least ¼" thick, and is capable of absorbing the liquid being stored without deterioration. Any liquid which leaks out of the inner tank flows through the wrapping to a low point at the bottom of the inner tank. Leak detection means such as a detection tube extends to this low point to permit detection of leakage.

Surrounding the wrapping material is liquid impervious envelope, such as a polyurethane bag. This envelope completely surrounds the inner tank and the polyethylene wrapping, and is sealed to all the inner tank inlet and outlet pipes and vents. The sealing of the envelope permits it to be pressure tested to insure there are no leaks.

Because the lightweight concrete is poured at the factory, the need for secured supports between the inner and outer tanks to hold them in the desired relative location and to prevent flotation of the inner tank is eliminated. Instead, concrete blocks are placed at the bottom of the outer tank, the inner tank is positioned within the outer tank on the blocks, and temporary steel support rods are tack welded between the inlet, outlet and vent pipes and fittings on the inner and outer tanks. The space between the tanks is partially filled and allowed to cure, the support rods are removed, and the balance of the concrete is poured into the space. Upon curing, the entire tank is transported to the use site and positioned on a suitable support such as a concrete pad to allow visual inspection of the exterior of the tank.

The use of a lightweight insulating material greatly reduces the expense of transporting the tank vault of the invention, making it economical to completely assemble the device at the manufacturing location. The lightweight encasing material reduces the need for reinforcement of the inner tank or the outer shell, thereby further reducing the overall weight of the device. Further, the provision of an outer shell, for example of steel, insures structural integrity of the vault not only during transportation, but during exposure to adverse environmental conditions. The integrity of the insulating material is maintained over a longer period of time and exposure to fire conditions does not cause destruction of the insulating layer when attempts are made to put out the fire. In addition, the outer shell provides another barrier to the leakage of hazardous materials.

DESCRIPTION OF THE DRAWINGS

A better understanding of the present invention and of additional advantages and objects will be had after consideration of the following specification and drawings, wherein:

FIG. 5 is a detailed view showing the inner support ribs of the inner tank of FIG. 1;

FIG. 6 is a detailed view of the side spacers between the inner tank and outer shell in the device of FIG. 1;

FIG. 7 is a cross-sectional view taken along line 7—7 of FIG. 2 shown in perspective after insulating material, such as concrete, has been poured between the inner tank and outer shell of the tank vault;

DESCRIPTION OF THE PREFERRED EMBODIMENTS

Figure 1:
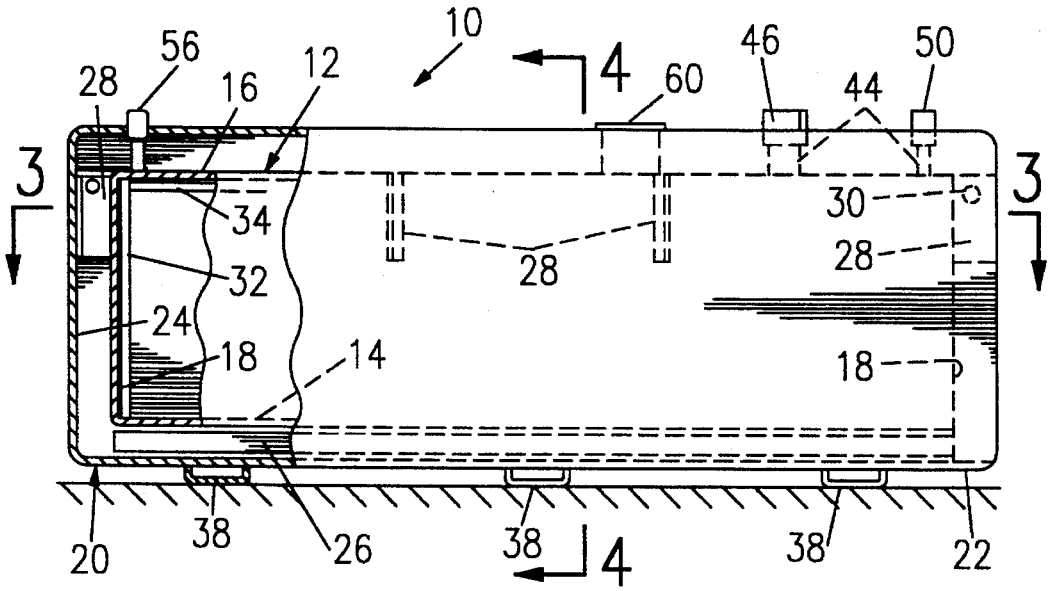
FIG. 1 is a side elevational view of a first embodiment the tank vault of the present invention.

Referring now to the drawings, a tank vault 10 is shown in FIGS. 1–7 as having an inner tank 12 including a bottom surface 14, top surface 16 and side surfaces 18. The inner tank may be constructed from various types of material including steel, corrosion-resistant steel, aluminum, cast iron, fiberglass, fiberglass-reinforced steel, and polyethylene. In the preferred embodiment, the inner tank is constructed from 3/16-inch thick steel.

The inner tank 12 is spaced apart from an outer shell 20 which also has a bottom surface 22 and side surfaces 24, while the top of the outer shell is open. In the preferred embodiment, the outer shell is made of 10 gauge steel. The inner tank 12 and outer shell 20 are attached in a spaced apart relationship by a first, bottom spacer 26 which, in the preferred embodiment, may be constructed from a C-shaped steel channel that is six inches long and weight 8.2 pounds per foot (C×6×8.2). This same C-shaped channel material may also be used as a second side spacer 28 which attaches and spaces the side surfaces 18 and 24 of the inner tank and outer shell. These spacers provide a continuous, substantially uniform space between the tank 12 and the shell 20 for receiving concrete or other material.

The first, bottom spacer 26 may be attached to the bottom surface 14 of inner tank 12 by welding. The inner tank 12 may then be lowered into the outer shell 20 and the first, bottom spacers 26 attached to the bottom surface 22 of the outer shell 20 by welding plugs which are formed by welding through small holes in the bottom surface 22 directly to the lower surface of the bottom spacers 26 to fill the holes and thus produce the welding plug for the attachment of the spacers 26. Generally, it is not necessary to use welding plugs to attach the second, side spacers 28 to the side surfaces 24 of outer shell 20, as seen in FIG. 6. FIG. 6 shows an aperture 30 in the side spacer 28 which may be used to secure a hook for lifting the inner tank 12 to place it in the outer shell 20, and for lifting the assembled tank vault 10 onto a truck or from a truck to place it at the desired location upon the site where the tank vault 10 is to be used. It will also be seen in FIG. 6 that the upper edges of the side walls 24 of outer shell 20 are each provided with a radius which establishes a smooth rounded upper edge of the tank vault 10 once the insulating material, such as concrete, is poured into the space between the inner tank 12 and outer shell 20. It will also be seen in FIGS. 1, 6 and 7 that the side spacers 28 do not extend to the bottom surfaces 14 or 22 of the inner tank 12 or outer shell 20. Similarly, the bottom spacer 26 does not extend to the side walls 24 of outer shell 20. This permits the insulation material to flow completely between the inner tank 12 and outer shell 20.

The preferred embodiment shows an inner tank 12 in the shape of a rectangular block with the outer shell 20 also shaped as a rectangular block. Other configurations are possible within the teachings of the present invention, including a cubically-shaped inner tank and outer shell or a cylindrically-shaped inner tank mounted within an outer shell in the form of a rectangular block. In this latter arrangement, the bottom surface of the inner tank is the bottom edge of the cylindrical shape while the side walls include the two side edges of the cylinder and the two flat ends thereof.

It has been found that the second, side supports 28 are very important in the assembly of the inner tank 12 and outer shell 20 in that the pouring of the insulating material, such as concrete, can cause the inner tank 12 to float within the outer shell 20. This problem has not occurred in the prior art as the prior art generally does not contemplate such a large volume of light-weight insulating material when assembling a tank from separate inner and outer tanks. To prevent the flotation of the inner tank 12 within the outer shell 20, the bottom spacers 26 and/or side spacers 28 securely attach the tank 12 within the shell 20. Further, the prior art does not contemplate the additional problems that are experienced when a fluid insulating material, such as concrete, is poured to fill the space between the inner tank 12 and the outer shell 20. Such additional problems include the possible bowing of either the inner side walls 14 of tank 12 or the outer side walls 20 of shell 20 and the possible collapse of the top surface 16 of tank 12 when covered with cement. To eliminate these problems, inner channel-shaped supports are utilized in tank 12, including inner side supports 32, shown in FIGS. 1, 3, 4, 5 and 7, and inner top supports 34, shown in FIGS. 1, 2 and 4. In the preferred embodiment, the inner side supports 32 are made of 10 gauge steel sheets with a hat-shaped cross-section having a three inch crown, one inch sidewalls and a one inch brim on the outer edge of each side wall. In the preferred embodiment, the inner top supports 34 are formed from the same material and in the same shape.

Further support may optionally be provided to the side surfaces 18 of inner tank 12 by cross-rib supports 36 illustrated in FIGS. 3, 4, 5 and 7. It will be seen in FIGS. 3 and 4 that the preferred embodiment may include three pairs of cross-rib supports which attach opposite side walls 18 of the inner tank 12 at the inner side supports 32. As illustrated in FIG. 7, the cross-rib supports 36 are formed from a 2×2×¼-inch angle channel and are attached at opposite ends to the inner supports 32, as by welding. Similarly, the inner side supports 32 and top supports 34 are attached to the side surfaces 18 and top surface 16 of the inner tank 12 by welding.

Figure 2:
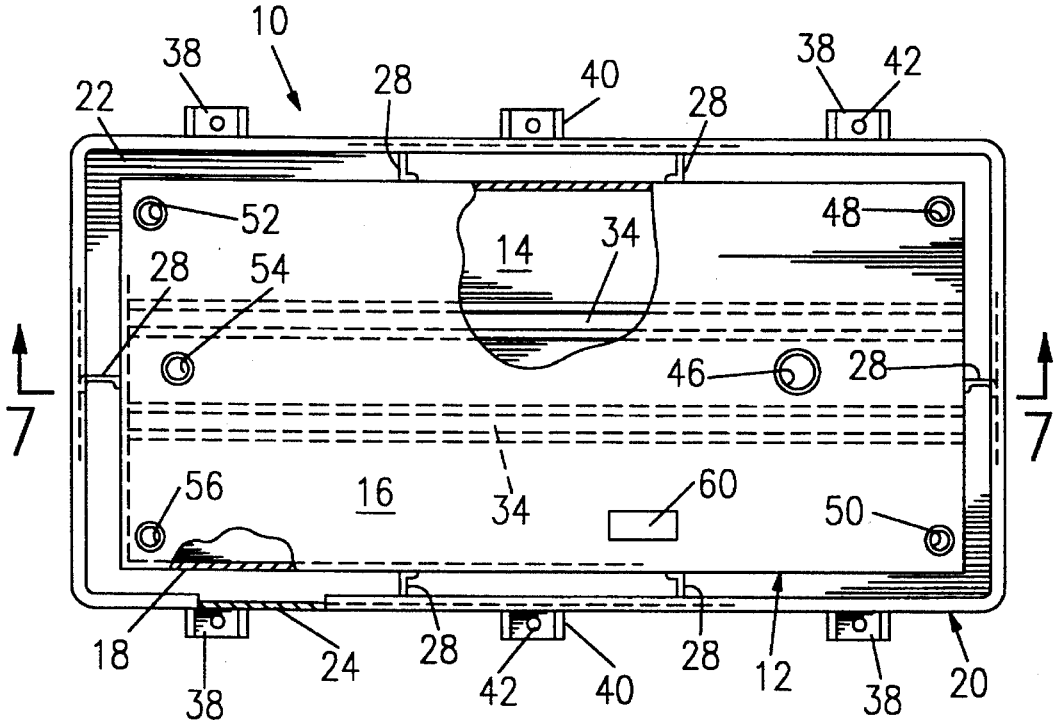
FIG. 2 is a top plan view thereof.
Figure 3:
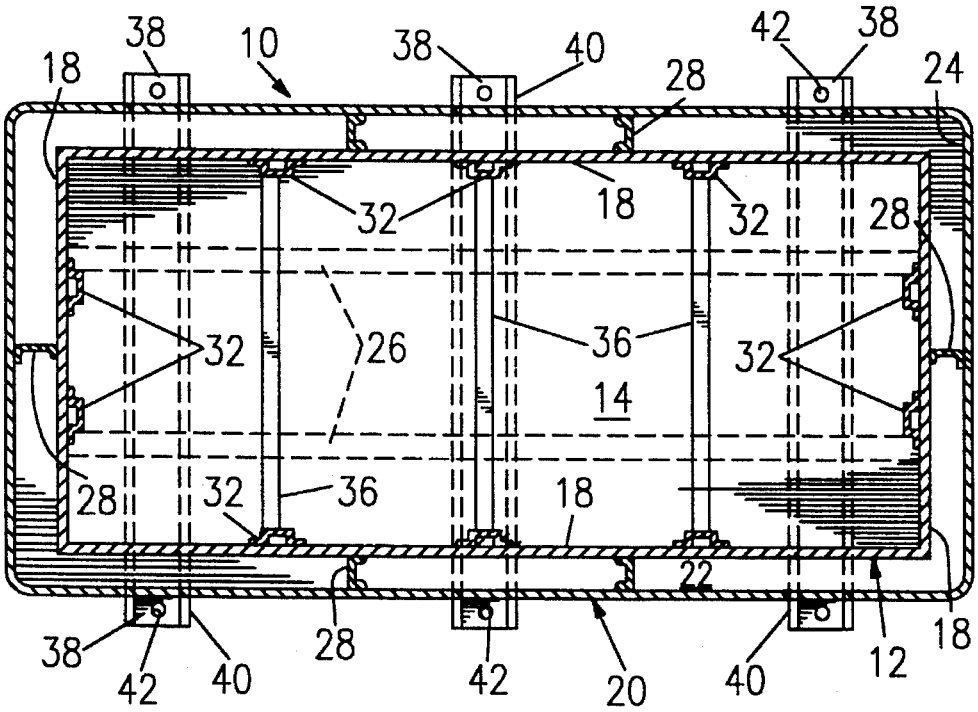
FIG. 3 is a cross-sectional view taken along line 3—3 of FIG. 1.
Figure 4:
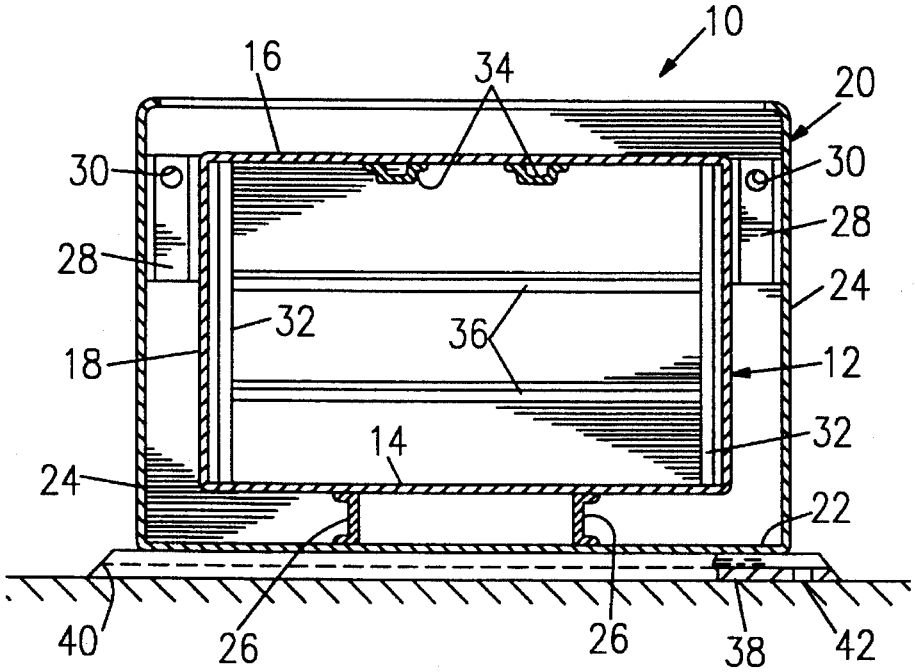
FIG. 4 is a cross-sectional view taken along line 4—4 of FIG. 1.

To complete the prefabricated assembly of the tank vault 10, a third set of spacers, or mounting feet 38, illustrated in FIGS. 1, 2, 3, 4 and 7, are attached to the bottom surface 22 of outer shell 20, as by welding. These mounting feet 38 may be formed from the same C-shaped channel material that forms the bottom and side spacers 26 and 28. As best seen in FIGS. 2, 3 and 4, the mounting feet 38 extend beyond the width of the outer shell 20 to form extensions 40 which incorporate apertures 42. These apertures receive suitable lag bolts or other fasteners which may be driven into a concrete mounting pad or other suitable mounting surface upon which the tank vault 10 is ultimately placed. The extensions 40 thus provide a convenient way for securing the tank vault 10 to the surface of its mounting site to prevent the tank 10 from moving during an earthquake.

As best seen in FIGS. 1 and 2, the top surface 16 of inner tank 12 is provided with several apertures into which various sized pipe fittings 44 may be attached, as by welding. The purpose of these pipe fittings 44 are many and varied. In the preferred embodiment shown in FIG. 2, they include the following: a six-inch tank bung 46 located in the center of the right-hand portion of the top surface 16 for mounting a 2.5-pound emergency vent; a two-inch tank bung 48 located in the upper, right-hand corner of the top surface 16 for a vent; a two-inch tank bung 50 located in the lower, right-hand surface of tank cover 16 to mount a sight level gauge; a four-inch tank bung 52 in the upper, left-hand corner of top surface 16 for a phase one vapor recovery device; a four-inch tank bung 54 in the center, left-hand section of the top surface 16 for filling the tank 10; and a two-inch tank bung 56 in the lower, left-hand corner of surface 16 for a gas pump.

In one version, the tank vault 10 shown in FIGS. 1–7 weighs approximately 2,400 pounds in the prefabricated state as shown in FIGS. 1–6 and holds 1,000 gallons. It will be understood that several variations of the tank structure are possible and that the specific shapes and sizes of the inner and outer tanks, the bottom spacers 26, side spacers 28, mounting feet 38, side supports 32, top surfaces 34, and cross-rib supports 36 may all vary without departing from the teachings of the present invention. Further, the inner tank 12 may be fabricated with a double sided top, sides and bottom as shown in FIG. 7. The size of the tank vault 10 may also vary to accommodate different volumes, such as 250, 500, 1,000 and 2,000 gallons.

In the present invention, it is anticipated that a 250 gallon tank vault 10 would have an inner tank 12 with a length of 80 inches, a height of 25 inches, and a width of 30 inches. The dimensions of the outer shell 20 would be a length of 92 inches, a height of 37 inches, and a width of 42 inches. This 250 gallon tank would have a single side spacer 28 that is 12 inches long and two sets of vertical inner side supports 32 with a single cross-rib support 36 between each. A 500 gallon tank 10 would have an inner tank dimension of 120 inches long by 26 inches high by 37 inches wide, and an outer shell dimension of 132 inches long by 38 inches high by 49 inches wide. Two die spacers 28 would be provided between the side walls 18 of the inner tank 12 and side walls 24 of the outer shell 20, while the inner side supports 32 number three along the long side wall with single cross-rib supports 36 therebetween. A 1,000 gallon tank would have an inner tank dimension of 120 inches long by 46 inches high by 42 inches wide, with the outer shell dimensions being 132 inches by 58 inches by 54 inches. The inner supports would be the same as for the 500 gallon tank except that there would be two cross-rib supports 36 between each of the inner side supports 32 rather than one. A 2,000 gallon tank would include an inner tank 12 with a length of 120 inches, a height of 55 inches, and a width of 70 inches; while the outer shell would measure 132 inches long by 67 inches high by 82 inches wide. The side supports 28 are twice as long as the side supports within the 1,000 gallon tank, while the inner side supports 32 and cross-rib supports are the same in number as for the 1,000 gallon tank. Each tank has the same number of bottom spacers 26 for providing a standoff between the inner tank and outer shell. The 250 gallon tank has two mounting feet 28, while the remaining tanks have three.

After the tank vault 10 has been properly placed at the desired site, the space between inner tank 12 and outer shell 20 may be filed with a suitable insulating material 58, shown in FIG. 7. In the preferred embodiment, this insulating material is concrete. However, other materials may be used including cement, sand, gravel, a heat-resistant plastic such as polyethylene, or a fire-retardant foam. In general, the material should be fire-resistant and meet or exceed a two-hour firewall rating. In some situations, such as when the tank is intended to be used to store waste oil, for example, it may not be necessary to fill the space between the inner and outer tanks with any insulating material 48. As the insulating material 58 is poured into the space between the inner tank 12 and outer shell 20, the tanks are vibrated by a suitable vibrating tool to ensure that all spaces between the tank and shell are filled. The outer shell is then filled to a level equal to the upper edge of its side walls 24 so that the rounded edges thereof are flush with the upper surface of the insulating material. A T-shaped standoff 60 may be attached to the top surface 16 of inner tank 12, as by welding. It will be seen that the standoff 60 is flush with the upper surface of the insulating material 58. This standoff 60 thus provides a mounting platform upon which to place a nameplate or other information. Once filled with concrete 58, for example, a gasoline pump, not shown, may be mounted to the side surface 24 of the outer shell 20 and connected to the inch-long tank bung 56.

As discussed above, many shapes of the inner tank 12 and outer shell 20 are possible. The inner tank 12 may be constructed from several different materials and the space between it and the outer shell 20 may be varied and filled with several different insulating materials within the teaching of this invention. Further, the shape, number, configuration and material of the bottom spacers 26, side spacers 28, inner side supports 32, inner top supports 34, cross-rib supports 36, and mounting feet 38 may vary within the teachings of this invention. It will also be noted that the placement of the inner side supports 32 within the inner tank 12 is usually such that they do not align themselves with the side supports 28, thereby increasing the rigidity of the side walls 18.

Figure 8:
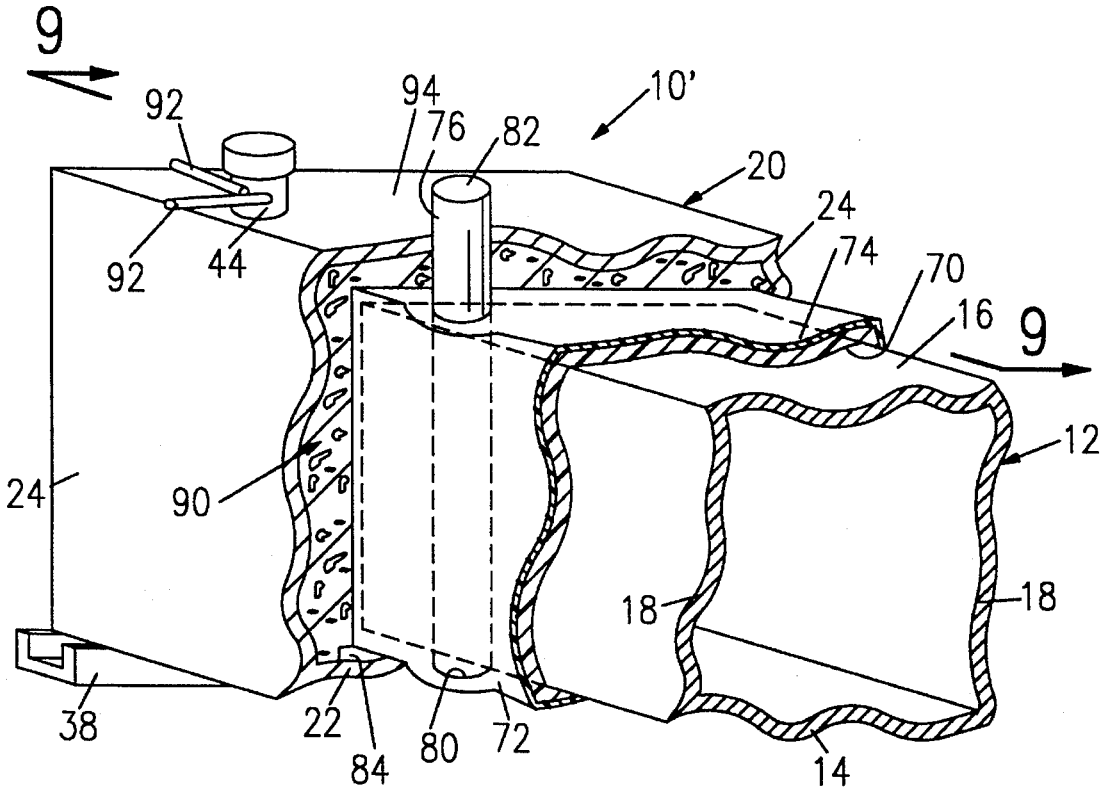
FIG. 8 is a cut-away perspective view of a modified form of the storage tank of the present invention.
Figure 9:
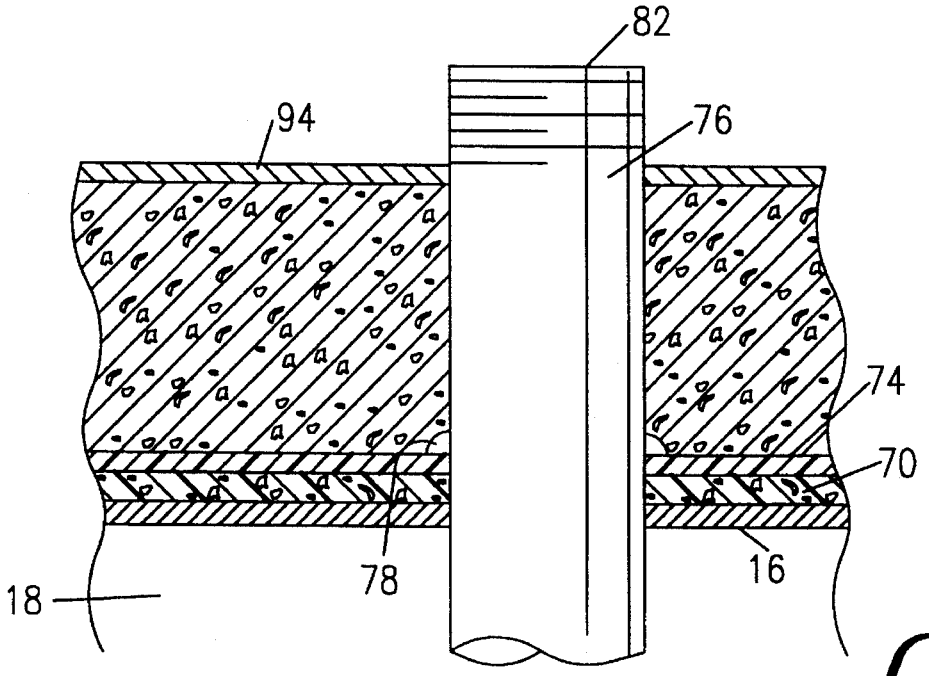
FIG. 9 is an enlarged sectional view of a portion of the tank of FIG. 8.

FIGS. 8 and 9 illustrate a modified form of the present invention, with elements common to the embodiment of FIGS. 1–7 being similarly numbered. In this embodiment of the invention, the tank vault is preferably assembled at the factory for subsequent delivery to the site where it is to be used. As previously described, the modified tank vault, generally illustrated at 10', includes an inner tank 12 which incorporates a bottom surface 14, top surface 16, and side surfaces 18. The inner tank preferably is constructed of steel, as previously described. Tank 12 is surrounded by a liquid-absorbing layer 70 which preferably is a polypropylene cellular sheet material which is commercially available and which absorbs any liquid which might leak out of tank 12. This is an open cell material which transports the absorbed liquid downwardly along the sides 18 of the inner tank and allows the material to collect at a low collection point 72 beneath the midpoint of the inner tank 12 and preferably to one side thereof. This low point may be formed by shaping the cellular material on the bottom surface 14 of the tank, as by providing a thickened region in the area 72 and a cavity for receiving collected liquid. Preferably, the cellular liquid absorbing material 70 is approximately ¼ thick to ensure that the liquid will easily flow to the low point 72 for detection purposes, as will be described. An advantage of the polypropylene cellular material is that it does not disintegrate when contacted by liquids such as gasoline, thus retaining its shape to ensure that the leakage will flow to the low point 72.

A sealed polyurethane container, or bag 74 completely surrounds the inner tank 12 and the layer 70. The polyurethane layer 74 may be a 15 ml cross linked polyurethane which is impervious to most flammable liquids. The bag 74 fits around the various pipe fittings 44 and any of the vents or other protrusions extending out of the inner tank, as well as fitting around detector pipe or tube 76. The bag is sealed against such fittings, protrusions and pipes as by a plastic weld 78 illustrated in FIG. 9 as surrounding pipe 76. Such welds ensure that bag 74 is air tight. The bag can be pressure tested to ensure that it has no leaks. The polyurethane bag 74 thus provides a secondary containment for any fluids that might leak out of tank 12. It also encloses and forms a lower wall for the cavity formed at the collection point 72.

The detector tube 76 extends vertically downwardly along side wall 18 of the tank 12 with the lower end 80 of the detector being located in the collection region 72. The upper end 82 of the detector tube extends above the tank assembly after it has been completed so that access to the collection point 72 is available from outside the tank vault 10'. Preferably, the tube 76 is constructed of a material which is impervious to the liquid being stored.

In the embodiment of FIG. 8, the storage tank 10' is assembled by placing the tank 12 inside the outer containment shell 20. As previously discussed, shell 20 includes a bottom surface 22 and side surfaces 24, with the top of the shell being open. The inner tank may rest on suitable blocks of the insulating material which is used to surround the inner tank, and thus may rest on a plurality of spaced blocks 84 (FIG. 8). In assembling the tank vault, the inner tank is positioned within outer shell 20 so as to have substantially equal spacing between the respective side and bottom walls of the tank 12 and the shell 20 to insure uniform thermal protection of the material within tank 12. The thickness of the support blocks 84 determines the space between the bottom 14 of tank 12 and the bottom 22 of shell 20, and that distance preferably is about the same as the distance between side walls 18 and 24 of the inner tank and the outer shell, respectively.

After the inner tank has been positioned, a cellular concrete commercially available under the name Elastizell, or other lightweight insulating material 90 is poured in fluid form into the space between the inner tank assembly and the outer shell 20. The inner tank assembly includes the tank 12 and the surrounding liquid absorbing cellular material 70 and its containment bag 74. Since the inner tank 12 will be empty at this time, the insulating material 90 may tend to cause the inner tank to float and to move upwardly out of shell 20. To prevent this, a plurality of positioning rods 92, illustrated in FIG. 8 and indicated in dotted lines in FIG. 7, may be tack-welded between selected pipe fittings 44 and the wall of the outer shell 20. These rods 92 will provide sufficient downward force to prevent flotation of the tank 12 and will also prevent the tank from shifting within shell 20 as the material 90 is poured in place. Elastizell is a foaming solution which is added to cement to form a foamed cement which can be poured into the outer shell. When cured, the foam leaves air bubbles throughout the cement, and leaves the cement with a dry density of 30 to 40 pounds. Perlite can similarly be mixed with cement to provide a lightweight insulating material with the same dry density.

In contrast to the embodiment of FIG. 1, the tank vault 10' need not be vibrated during the addition of the insulating material 90 to insure that it flows under tank 12 and completely fills the space between the inner tank and the outer shell, since the material 90 flows like a liquid. Because the insulating material 90 is poured at the factory, in this embodiment of the invention, the supports 28 of the embodiment of FIG. 1 are not required. Instead, the positioning rods are tacked into place, and the concrete is poured so as to fill the outer shell 20 approximately half way up its height. The insulating material, which preferably is the lightweight concrete noted above, is allowed to cure and thereafter the positioning rods 92 are removed. Finally, the balance of the insulating concrete material 90 is poured into the remaining space between the inner tank and the outer shell and covers the top surface 16 of the inner tank to a thickness about equal to the thickness between the side walls and between the bottom walls of the inner and outer vessels. Upon curing of this latter pour a cover 94 is secured to the top of shell 20 as by welding, for example, and the tank is ready to be transported from the manufacturing site to a suitable location of use. The cover 94 fits closely around the fittings 44 and other pipes to protect the insulating material 90.

The use of a cellular concrete, which does not include an aggregate but instead incorporates numerous air pockets, provides a tank which is sufficiently light to permit it to be assembled and furnished at the factory. Although lightweight insulating concrete is preferred, perlite or an insulating foam may also be used. The insulating material permits the inner tank to withstand a 2,000 degree fire test by providing approximately 6" thick walls. This enables the inside tank wall to remain below the ignition point of insulation gasoline so as to enable the tank of the present invention to meet Underwriter's Laboratory's standards for fire resistance.

The low density polyurethane containment bag surrounding the polypropylene moisture absorbing material provides an annular space around the inner tank 12 which not only provides for leak detection, but also eliminates any contact between the lightweight concrete 90 and the inner tank 12. This provides corrosion protection as well as providing for leak detection. The leak detecting tube 72 may be 2" in diameter and preferably is located at the midpoint of the tank, running vertically down the tank and extending slightly below the bottom wall 14.

Although the present invention has been described in terms of a preferred embodiment, it will be apparent that numerous modifications and variations may be made without departing from the true spirit and scope thereof, as set forth in the following claims.

What is claimed is:

1. A tank assembly for storing liquids comprising:

an inner tank having an interior within which liquids are stored, said inner tank having outer wall surfaces;

a liquid absorbing material which will not disintegrate upon contact with liquid contents of the inner tank, said liquid absorbing material disposed about said outer wall surfaces of said inner tank;

a sheet-like liquid impervious material surrounding said liquid absorbing material, said sheet-like liquid impervious material defining an envelope surrounding said liquid absorbing material which prevents passage of liquids and moisture across said envelope;

an outermost tank surrounding said inner tank, liquid absorbing material and sheet-like liquid impervious material, said outermost tank spaced from said sheet-like liquid impervious material such that a space is defined between said sheet-like liquid impervious material and said outermost tank; and a pourable air-entrapped concrete insulating material disposed in said space defined between said outermost tank and said sheet-like liquid impervious material, said pourable air-entrapped concrete insulating material being cured in situ.

2. The tank assembly of claim 1, wherein said liquid absorbing material comprises a cellular liquid absorbing material.

3. The tank assembly of claim 1, wherein said liquid absorbing material comprises a polypropylene cellular material.

4. The tank assembly of claim 1, further including at least one protrusion having a passageway therein to provide access to said inner tank, said at least one protrusion extending from said inner tank and through said liquid absorbing material and through said sheet-like liquid impervious material, the assembly further including a weld disposed about said at least one protrusion at a location at which said at least one protrusion extends through said sheet-like liquid impervious material to thereby seal said sheet-like liquid impervious material about said at least one protrusion.

5. The tank assembly of claim 4, further including a detector tube extending through said liquid impervious material, said detector tube including an opening disposed between said inner tank and said liquid impervious material, said detector tube thereby providing access for leak detection.

6. The tank assembly of claim 5, wherein said opening of said detector tube is disposed beneath said inner tank.

7. The tank assembly of claim 1, further including a detector tube extending through said liquid impervious material, said detector tube including an opening disposed between said inner tank and said liquid impervious material, said detector tube thereby providing access for leak detection.

8. The tank assembly of claims 7, wherein said opening of said detector tube is disposed beneath said inner tank.

9. The tank assembly of claim 7, wherein said detector tube extends through said outermost tank.

10. The tank assembly of claim 1, wherein said sheet-like liquid impervious material comprises a polyurethane bag.

11. The tank assembly of claim 1, wherein said sheet-like liquid impervious material comprises a cross-linked polyurethane.

12. The tank assembly of claim 1, wherein said pourable air-entrapped concrete includes a foaming agent.

13. The tank assembly of claim 1, further including at least one spacer for holding said inner tank during introduction of said pourable air-entrapped concrete insulating material.

14. The tank assembly of claim 1, wherein said pourable air-entrapped insulating material has a thickness of approximately six inches.

15. The tank assembly of claim 1, wherein said sheet-like liquid impervious material includes a plastic bag.

16. The tank assembly of claim 15, wherein said liquid absorbing material comprises a polypropylene cellular material and said air-entrapped concrete insulating material includes a foaming agent.

17. The tank assembly of claim 16, wherein said polypropylene cellular material has a thickness of approximately ¼ inch and said air-entrapped concrete insulating material has a thickness of approximately six inches.

18. The tank assembly of claim 17, further including a leak detector tube extending between said sheet-like liquid impervious material and said inner tank to thereby provide access to said liquid absorbing material for detection of liquids absorbed by said liquid absorbing material.

19. The tank assembly of claim 18, wherein said outermost tank is steel.

20. The tank assembly of claim 1, wherein said outermost tank is steel.

21. A tank assembly for storing liquids comprising:

an inner tank having an interior within which liquids are stored, said inner tank having outer wall surfaces;

a liquid absorbing material which will not disintegrate upon contact with liquid contents of the inner tank, said liquid absorbing material disposed about said outer wall surfaces of said inner tank;

a sheet-like liquid impervious material surrounding said liquid absorbing material, said sheet-like liquid impervious material defining an envelope surrounding said liquid absorbing material which prevents passage of liquids and moisture across said envelope;

an outermost tank surrounding said inner tank, liquid absorbing material and sheet-like liquid impervious material, said outermost tank spaced from said sheet-like liquid impervious material such that a space is defined between said sheet-like liquid impervious material and said outermost tank; and a pourable concrete insulating material disposed in said space defined between said outermost tank and said sheet-like liquid impervious material, said pourable concrete insulating material being cured in situ.

* * * * *